US007160216B2

(12) United States Patent
Failla Colonnello Seppi et al.

(10) Patent No.: US 7,160,216 B2
(45) Date of Patent: Jan. 9, 2007

(54) ACCESSORY FOR RACKETS

(76) Inventors: Raffaele Failla Colonnello Seppi, Via L. Muratori, 3, Milan RN (IT) 20135; Marco Luigi Davide Silva, Via D. Campana, 51/A, Rimini RN (IT) 47900

( * ) Notice: Subject to any disclaimer, the term of this patent is extended or adjusted under 35 U.S.C. 154(b) by 0 days.

(21) Appl. No.: 11/138,682

(22) Filed: May 27, 2005

(65) Prior Publication Data

US 2005/0266942 A1 Dec. 1, 2005

(30) Foreign Application Priority Data

Jun. 1, 2004 (EP) ..... 04425405

(51) Int. Cl.
*A63B 49/08* (2006.01)

(52) U.S. Cl. ..... 473/551; 473/553

(58) Field of Classification Search ..... 473/549, 473/551–553, 201, 203, 206, 300–303, 463
See application file for complete search history.

(56) References Cited

U.S. PATENT DOCUMENTS 1,075,054 A * 10/1913 Morley ..... 473/206
2,481,778 A * 9/1949 Pearson ..... 473/206
2,993,256 A * 7/1961 Muhlegg ..... 24/278
3,817,521 A 6/1974 Wright
4,072,311 A * 2/1978 Bertucci ..... 473/551
4,402,508 A 9/1983 Pflueger
4,961,572 A 10/1990 Badillo et al.
5,018,734 A 5/1991 Allsop
5,867,868 A * 2/1999 Ward ..... 16/422
5,924,941 A * 7/1999 Hagey ..... 473/551
5,931,749 A * 8/1999 Hagey ..... 473/551
6,305,051 B1 * 10/2001 Cho ..... 16/430
6,916,260 B1 * 7/2005 Poteet ..... 473/551
2005/0266942 A1 * 12/2005 Failla Colonnello Seppi et al. ..... 473/551

FOREIGN PATENT DOCUMENTS

DE 3202194 A1 8/1983

* cited by examiner

*Primary Examiner*—Raleigh W. Chiu
(74) *Attorney, Agent, or Firm*—Browdy and Neimark, PLLC

(57) ABSTRACT

An accessory for rackets having an adjustable belt (1*a*) or a fastener 1(*b*) for stable connection to a handle (M) of a racket (R) and contact means (2) having a shaped concave guide (3) for a user's hand (H), designed to identify the correct position of the user's hand (H) when changing the grip from the grip used for forehand strokes to that used for backhand strokes.

6 Claims, 3 Drawing Sheets

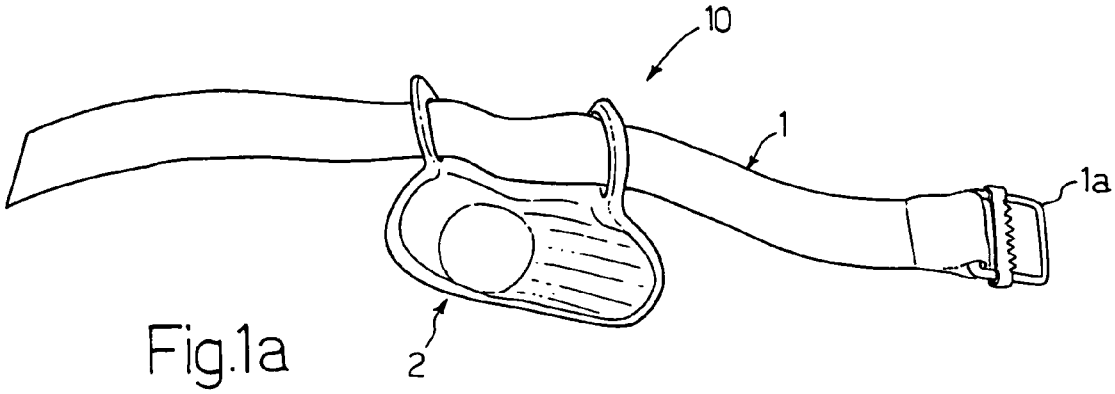
Fig.1a
Fig.1
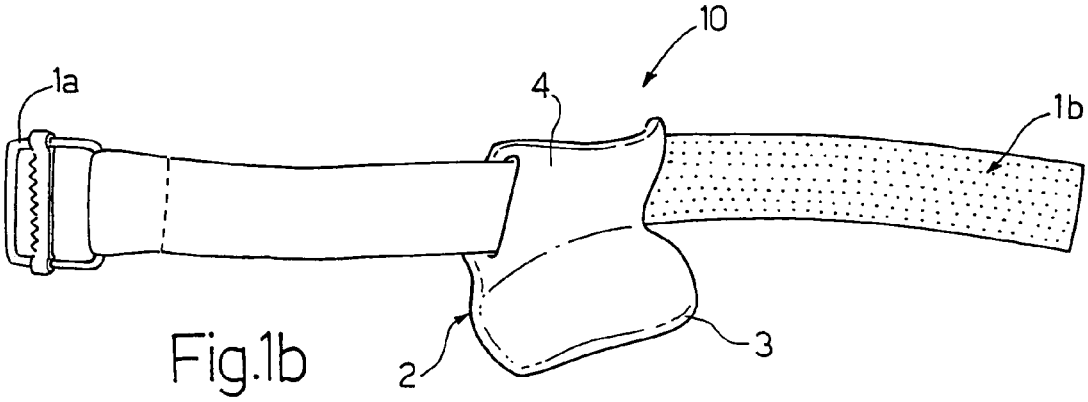
Fig.1b
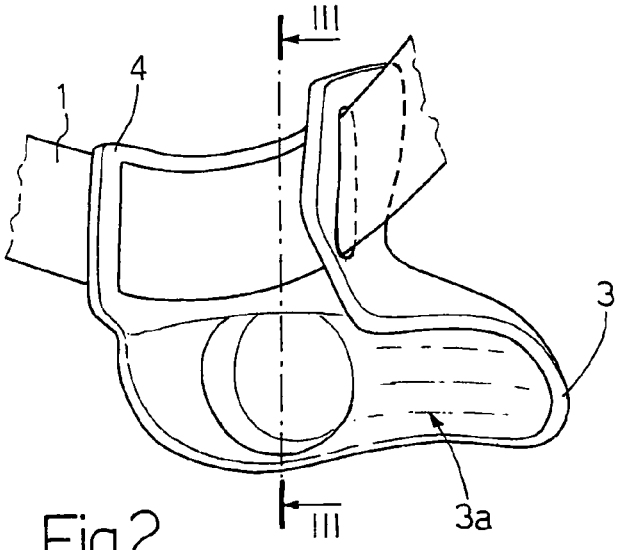
Fig.2
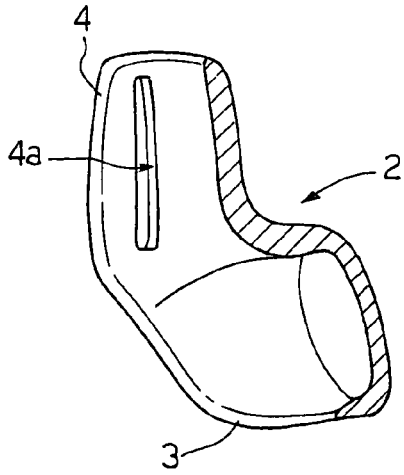
Fig.3

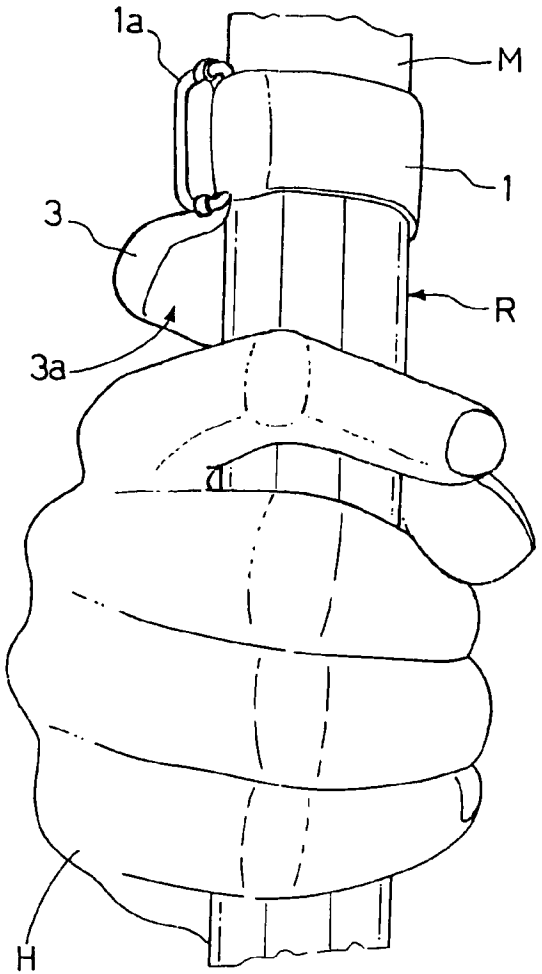
Fig.4b
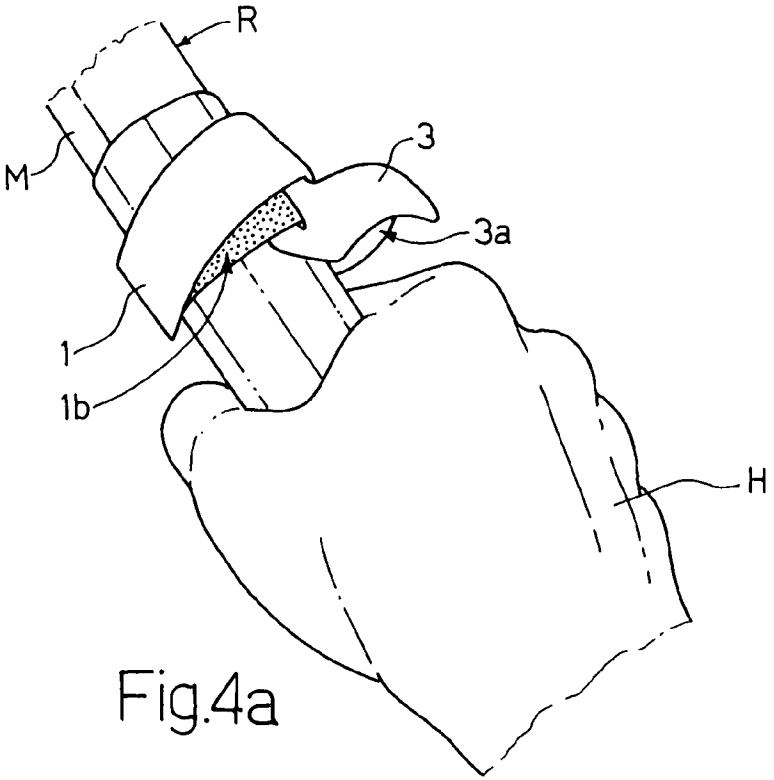
Fig.4a
Fig.4

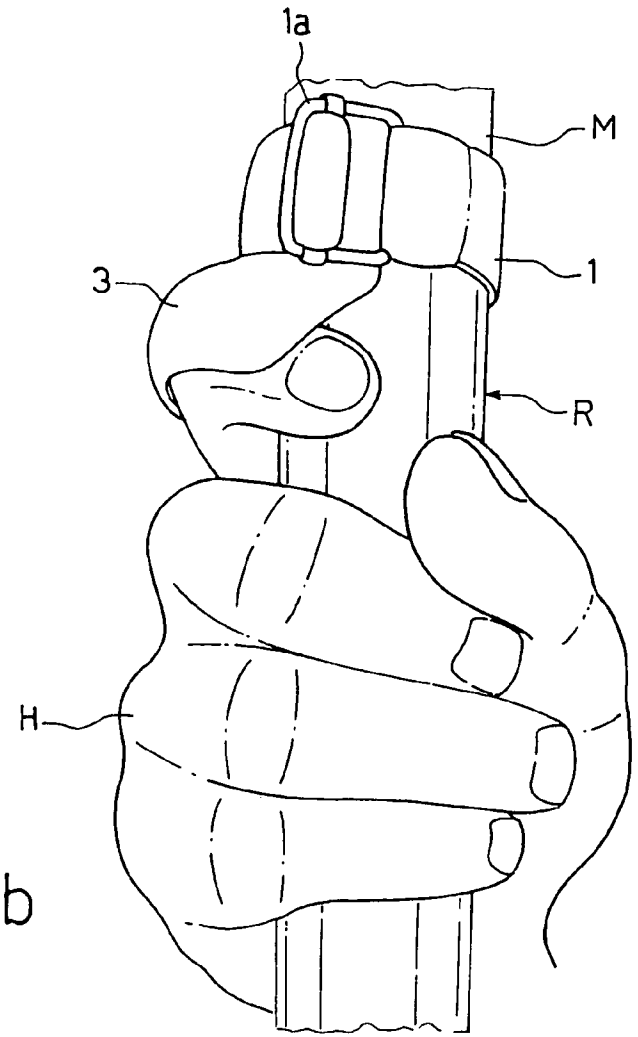
Fig.5b
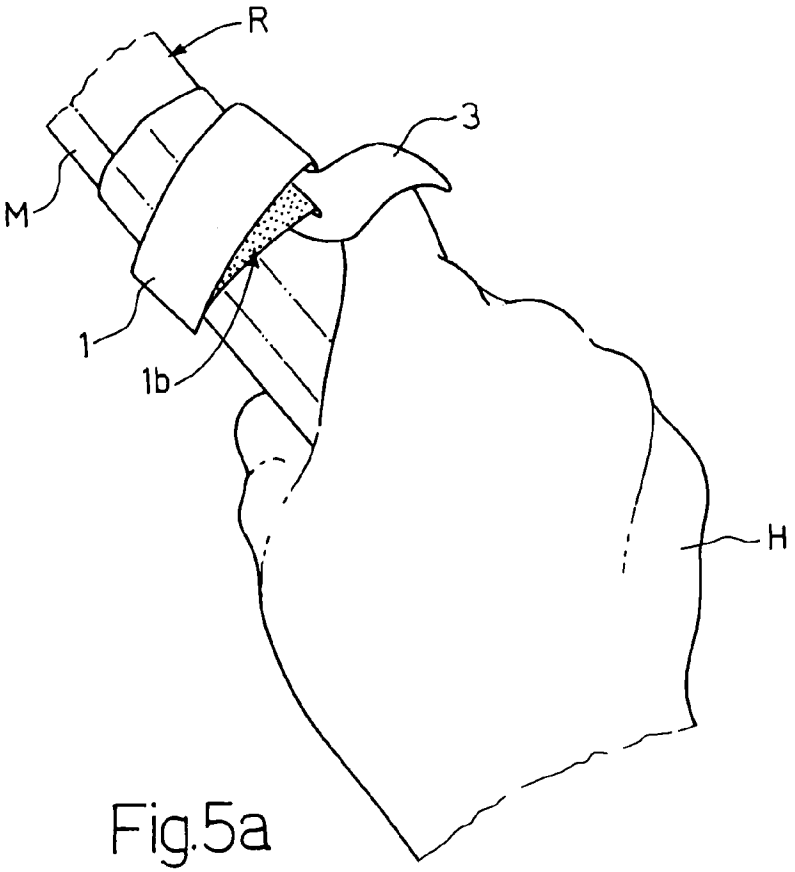
Fig.5a
Fig.5

ACCESSORY FOR RACKETS

TECHNICAL FIELD

The present invention relates to an accessory for rackets.

BACKGROUND ART

It is known, at least to experts in the field, that in sports in which rackets are used (tennis, squash, badminton, table tennis) forehand and backhand strokes can only be performed correctly if one changes one's grip on the racket handle.

In particular with reference to tennis, which is the best known and most widely practised of the above-mentioned sports, first of all it should be remembered that there are three basic grips: "Eastern forehand" (for forehand strokes), "Eastern backhand" (for backhand strokes) and "Continental" (for volleys); as well as some variations, both for forehand strokes ("Semi-Western", "Western" and "Full-Western" forehand) and backhand strokes ("Western" backhand), mainly used by medium-high level players.

Playing a backhand with the grip used for forehand strokes would result in a racket string position which is too open and would reduce the effectiveness of the strokes, since it would direct the backhand upwards and reduce its range. Therefore, it is customary to teach players to change their grip on the racket, whether strokes are performed while gripping it with one or two hands, turning the handle in the dominant hand (the right hand for right-handed players and the left hand for left-handed players).

Particularly during an initial approach to the game, whilst learning the various strokes, beginners do not find it easy to automatically master all of the correct behaviour for the best stroke. The correct torso posture, position of the feet, the moment when the ball is hit and the position of the racket: it is easy to image that any accessory which allows the pupil to correctly master these basics of the game without thinking makes it much easier, both because it lets them concentrate on other details and because it leads them to automatically perform and improve on a movement much more rapidly.

There are no accessories or devices on the market which allow players to correctly automatically perform the passage from the correct grip for forehand strokes to the correct grip for backhand strokes.

SUMMARY OF THE INVENTION

The aim of the present invention is, therefore, to eliminate the above-mentioned disadvantages.

This is achieved thanks to an accessory, applicable to the racket handle, which allows immediate identification of the correct grip for backhand strokes.

The main advantage of the present invention is basically that a single model of this accessory is suitable for meeting the requirements of any user, irrespective of the type of racket used.

This significantly facilitates matters even in commercial terms, since it simplifies management of the warehouse and identifies an easily repeatable standard. Moreover, since the accessory is removable, the correct position can be identified for each user and the same accessory can be used for two or more different users, for example, for a series of pupils of a single instructor during the entire day of lessons.

Finally, the same accessory may also be used for correctly learning other, more difficult strokes.

BRIEF DESCRIPTION OF THE DRAWINGS

Other features and advantages of the invention are more clearly indicated in the detailed description which follows with reference to the accompanying drawings which illustrate a preferred non-restricting embodiment of it and in which:

FIG. 1 is a perspective view of the invention, not in use, illustrating the inside (FIG. 1*a*) and the outside (FIG. 1*b*);

FIG. 2 is a perspective view of a detail of the invention;

FIG. 3 is a cross-section of the detail illustrated in FIG. 2 according to III—III;

FIG. 4 illustrates the invention in a condition in which it is used, corresponding to the forehand grip, illustrating respectively the back (FIG. 4*a*) and the front (FIG. 4*b*) of the hand;

FIG. 5 illustrates the invention in a condition in which it is used, corresponding to the backhand grip, illustrating respectively the back (FIG. 5*a*) and the front (FIG. 5*b*) of the hand.

DETAILED DESCRIPTION OF THE PREFERRED EMBODIMENTS

As illustrated in the figures, the invention relates to an accessory for rackets, illustrated fitted on a tennis racket (R), comprising means (1) for stable connection to a handle (M) of a racket (R) and contact means (2) for a user's hand (H). The latter allow identification of the correct position of the hand (H) when gripping the racket (R) to perform strokes of a predetermined type, particularly for mechanically identifying the position of the hand (H) when it must change from the grip used for forehand strokes to that used for backhand strokes.

The connecting means (1) and contact means (2) can also be rigidly connected to one another, so that during use of the accessory (10) in question there is no risk of inadvertently changing their position.

However, in order allow more users to use the same accessory (10), it is convenient for the connecting means (1) to be removable, so that the position of the accessory (10) on the handle (M) can be changed when it is not being used.

The connecting means (1) may be made in many equivalent ways. For example, as illustrated in FIG. 1, they may comprise a small adjustable belt (1*a*), or, as illustrated in FIG. 2, a fastener (1*b*) which can be opened, consisting of a strip of Velcro.

The shape of the contact means (2) may also vary, having different equivalent forms. The drawings show that they may comprise a shaped concave guide (3), designed to cover, engage and hold the back of the joints of the forefinger when performing a stroke of a predetermined type. In particular, the guide (3) is positioned on the handle (M) of the racket (R) in such a way that when the grip must be changed to perform a backhand stroke, a rotation of the dominant hand automatically brings the back of the joints of the forefinger into a recess (3*a*) in the guide (3), which curves around handle (H) and opens downward toward the end of handle (H) as shown in FIG. 5(*b*), so that the user assumes the most correct grip for a backhand stroke.

In the example illustrated, the concave guide (3) is connected to a support (4) with slots (4*a*) in which the connecting means (1) can slide.

The invention described may be subject to modifications and variations without thereby departing from the scope of the inventive concept.

Moreover, all details of the invention may be substituted by technically equivalent elements.

In practice, obviously changes and/or improvements are possible which are covered by the claims herein.

What is claimed is:

1. An accessory for rackets, comprising a connection device adapted for engagement around a handle (M) of a racket (R) and a contact element (2) adapted to establish a preselected position on the handle for a user's hand (H) when gripping the racket (R) to perform strokes of a predetermined type, said connecting device (1) and said contact element (2) being engaged together on the handle in the preselected position;

wherein the contact element (2) comprises a shaped concave guide (3) having a preformed concave recess (3*a*);

wherein the concave recess (3*a*) curves around the handle and opens downward toward an end of the handle and covers, engages and holds around a back of the joints of a forefinger of the user when performing a backhand stroke.

2. The accessory according to claim 1, wherein the connecting device (1) is flexible so that the preselected position of the recess (3*a*) on the handle (M) can be changed.

3. The accessory according to claim 2, wherein the connecting device (1) is an adjustable belt (1*a*).

4. The accessory according to claim 2, wherein the connecting device (1) has a fastener (1*b*) which can be opened.

5. The accessory according to claim 4, wherein the fastener (1*b*) comprises strips of Velcro.

6. The accessory according to claim 1, wherein the contact element (2) has a support (4) having slots (4*a*), in which the connecting device (1) can slide.

* * * * *